United States Patent [19]

Jones

[11] Patent Number: 4,766,797

[45] Date of Patent: Aug. 30, 1988

[54] MOISTURE COLLECTION ATTACHMENT FOR BRASS MUSICAL INSTRUMENTS

[75] Inventor: Patrick T. Jones, Bowling Green, Ohio

[73] Assignee: Brasswell Corporation, Bowling Green, Ohio

[21] Appl. No.: 134,970

[22] Filed: Dec. 18, 1987

[51] Int. Cl.[4] ..... G10G 7/00
[52] U.S. Cl. ..... 84/453; 84/397
[58] Field of Search ..... 84/397, 453

[56] References Cited

U.S. PATENT DOCUMENTS

| | | | |
|---|---|---|---|
| 2,945,410 | 7/1960 | Ressler | 84/397 |
| 3,555,955 | 1/1971 | Sahaida | 84/397 |
| 4,016,794 | 4/1977 | Brown | 84/397 |

*Primary Examiner*—Lawrence R. Franklin
*Attorney, Agent, or Firm*—Marshall & Melhorn

[57] ABSTRACT

A device for attachment to the water key of a brass musical instrument for collecting and retaining moisture expelled from the instrument through the water key.

7 Claims, 1 Drawing Sheet

MOISTURE COLLECTION ATTACHMENT FOR BRASS MUSICAL INSTRUMENTS

BACKGROUND OF THE INVENTION

The prior art is replete with devices for collecting and retaining moisture, such as saliva, for example, which is periodically expelled from brass musical instruments after extended periods of use. Many of the devices function adequately to collect and retain moisture, but are attached to the associated instrument in a fashion which tends to adversely affect the musical characteristics of the instrument.

Also, many of the prior art moisture collecting devices are of a construction that will tend to mar, scrape, or scratch the highly polished, smooth, attractive surface of the associated instrument.

Certain other moisture collecting attachment devices are designed to be accommodated on only a limited number of instruments, and will not fit other instruments.

Still other moisture collecting attachment devices are so designed that in the attached mode, the device hinders, limits, or restricts full pivoting movement of the associated water key or drain valve.

Among the most pertinent prior art worthy of discussion is U.S. Pat. No. 4,016,794 issued to Lee A. Brown on Apr. 12, 1977. The patent discloses an attachment for a brass musical instrument suitable for collecting and retaining moisture. The device is attached to the instrument by Velcro tape or wire and is contoured to wrap around a portion of the instrument tubing which cooperate to dampen the natural resonance of the instrument, partially obstruct movement of the water key, and adversely affect the overall appearance and acoustics of the instrument.

SUMMARY OF THE INVENTION

It is a primary objective of the present invention to produce a moisture collection device which may be readily attached to a brass musical instrument without affecting or influencing the resonance of the associated instrument.

Another object of the invention is to produce a moisture collecting device which may be selectively attached to a broad range of brass musical instruments without adversely affecting the finish thereof.

Still another object of the invention is to produce a moisture collecting attachment for brass musical instruments which does not restrict or obstruct the flow of moisture from the water key or drain valve mechanism when in an open position.

A further object of the invention is to produce a moisture collecting device which may be economically fabricated and easily attached and removed from an associated brass musical instrument without requiring any special talent or tools.

These objects may be typically achieved by a device for attachment to the water key of a brass instrument which comprises a main body portion having a bottom and side wall means extending upwardly from the bottom defining a channel shaped cavity; and means integral with and extending from the main body portion for intimate selective attachment to the water key of an associated brass instrument.

BRIEF DESCRIPTION OF THE DRAWINGS

The above, as well as other objects and advantages of the invention, will become readily apparent to one skilled in the art from reading the following detailed description of a preferred embodiment of the invention when considered in the light of the accompanying drawings, in which.

DETAILED DESCRIPTION OF THE PREFERRED EMBODIMENT

Figure 1:
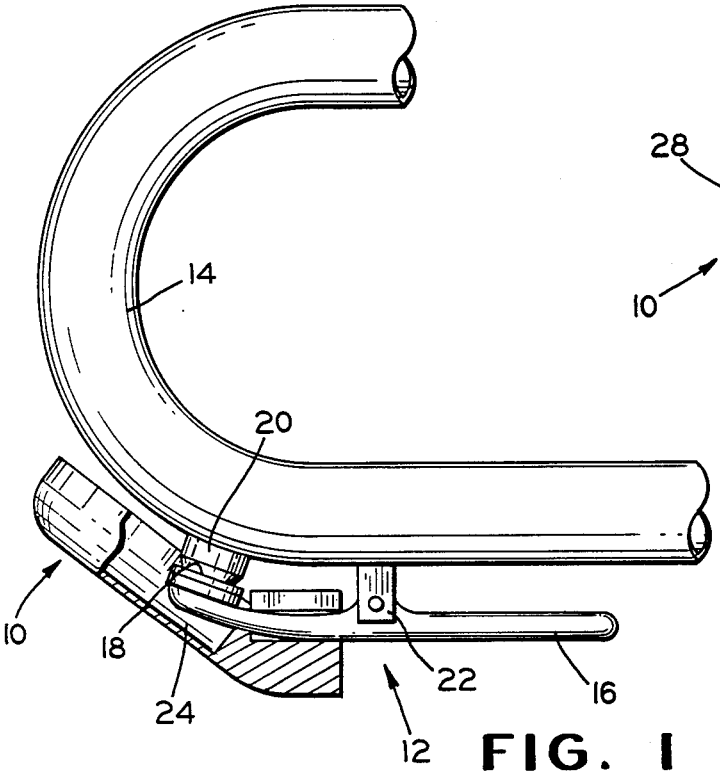
FIG. 1 is a fragmentary elevational view of a device incorporating the features of the invention with portions cut-away showing the invention attached to the water key of a brass musical instrument.

Referring to the drawings, and more particulary to FIG. 1 wherein a moisture collecting device 10 incorporating the features of the present invention is illustrated as being attached to the water key 12 of a brass wind musical instrument such as a trumpet, for example. The water key 12, or as sometimes referred as the drain valve, is typically mounted on the tuning slide 14 of the associated instrument.

It must be understood that water keys, such as are currently employed in brass wind instruments including trumpets, cornets, trombones, tubas and the like, are provided for the purpose of enabling the musician to selectively expel any accumulated moisture, such as saliva, from the interior of the instrument. The presently known water key structures may be constructed of a number of component parts including a pivotally mounted spring biased lever-type key 16 with a cork or pad 18 mounted at one end thereof and serving as the valving element in cooperation with an outlet 20 mounted on the slide 14 and providing communication with the interior thereof. The lever-type key 16 is mounted for pivotal movement within a mounting bracket 22 affixed to the outer wall of the slide 14. The key 16 is normally spring-biased so that the pad 18 carried by one end of the key 16 is normally in a closed position covering the outlet 20, as illustrated in FIG. 1.

Figure 2:
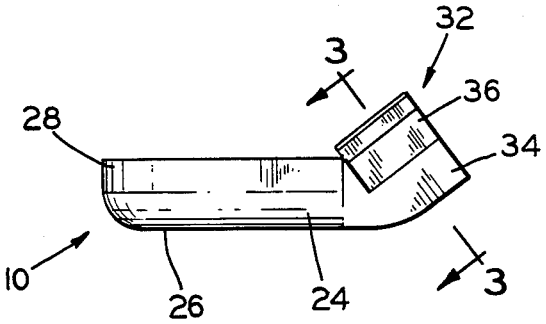
FIG. 2 is an elevational view of the moisture collecting attachment device illustrated in FIG. 1.
Figure 3:
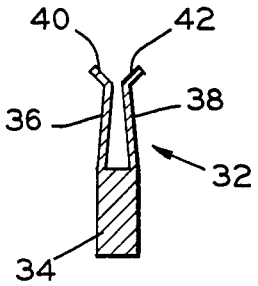
FIG. 3 is a cross-sectional view of the device illustrated in FIG. 2 taken along line 3—3 thereof.
Figure 4:
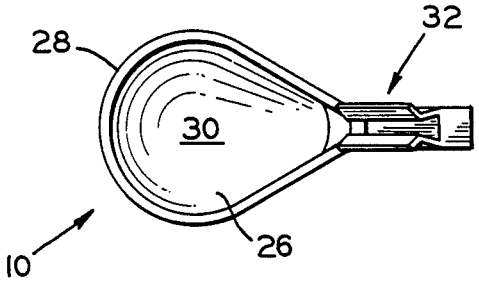
FIG. 4 is a plan view of the device illustrated in FIG. 2.

As will be readily apparent from viewing FIGS. 2, 3. and 4, the device 10 of the invention includes a main body 24 having a bottom 26 and an upstanding side wall 28 which cooperate to define a channel-shaped cavity generally indicated by reference number 30.

Extending laterally from the main body portion 24 is a spring clip 32 formed of a base section 34 and a pair of spaced apart resilient arms 36 and 38. The arms 36 and 38 are formed to terminate in outwardly flared camming surfaces 40 and 42, respectively.

While it will be appreciated that the device 10 can be fabricated from a number of different materials, it has been found that excellent results have been achieved by forming the device from a metal foil material such as an aluminum foil, for example. For best results, it has been found that the metal foil should have sufficient memory to enable the arm 36 and 38 to be resilient to thereby function properly during use as well as during application and removal.

More particularly, the device 10 is manually applied by grasping the main body portion 24 and the outwardly flared camming surfaces 40 and 42 are located to receive the water key 16 between mounting bracket 22 and the pad 18 and gently forced or pushed toward the tuning slide 14. The camming surfaces 40 and 42 are thereby cammed away from one another, increasing the spacing between the resilient arms 36 and 38. As soon as the camming surfaces pass over the key 16. the camming surfaces 40 and 42 are resiliently urged toward one another to cause the facing surfaces of the resilient arm 36 and 38 to snugly secure the device 10 to the water key 16 as illustrated in FIG. 1. Should it be desired to utilize a metal foil without the above degree of resiliency, the arms 36 and 38 could be manually forced together to securely attach the device 10 to the water key 16. An adhesive of the pressure sensitive type could also be employed to keep the arms 36 and 38 in a water key embracing attitude.

In the attached position illustrated in FIG. 1, it will be appreciated that the attachment 10 does not contact the tuning slide 14 and thereby does not affect the resonance of the associated instrument.

Figure 5:
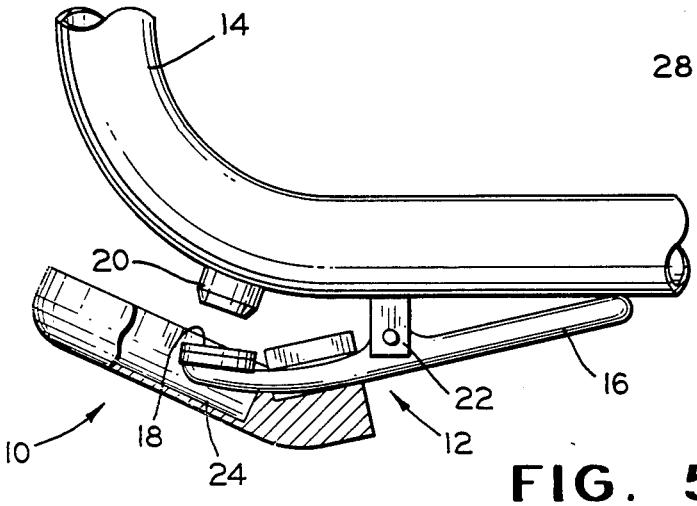
FIG. 5 is a fragmentary elevational view of the invention similar to the illustration of FIG. 1 with the moisture collecting device of the invention attached to the water key which is illustrated in an open position.

When it is desired to remove or expel any moisture which may have accumulated in the instrument, the water key 16 is manually moved to the open position illustrated in FIG. 5, and the musician blows air into the instrument causing the accumulated moisture to be forced outwardly through the outlet 20 and into the cavity 30. The attachment 10 may then be removed and discarded, and a new attachment applied.

If desired the user may spread apart the arms 36 and 38 and thence fold them over to form a cover for the cavity 30 to envelope the collected moisture to further enhance the hygienic aspects of the invention and militate against the escape of the collected moisture prior to being placed in an appropriate waste disposal system.

Figure 6:
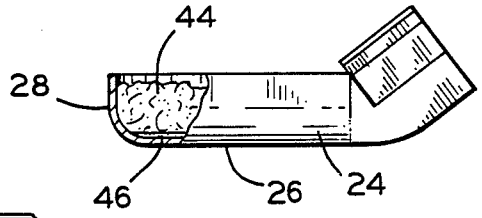
FIG. 6 is an elevational view of a moisture collecting attachment similar to that illustrated in FIG. 2 with a provision for containing an additional moisture absorbent material.

In an embodiment of the invention as illustrated in FIG. 6, an absorbent media 44 such as cotton or similar absorbent material may be inserted into the cavity 30. The absorbent media 44 may be retained in the cavity 30 by well known means such as the use of an adhesive layer 46, for example, or Velcro tape and other means. The use of an absorbent material 44 may tend to enhance the hygienic aspects of the device 10 and will enable the device 10 to retain a greater degree of moisture.

The size of the device 10 and the associated cavity 30 will vary and will depend upon the instrument with which it is contemplated for use.

Materials other than metal which could be utilized in constructing the device 10 include thermal setting plastic material, thermal plastic synthetic material, elastomeric material, and combinations thereof.

It will be appreciated that utilization of the aforedescribed invention results in a satisfactory moisture collecting attachment for brass musical instruments which will not adversely affect the resultant resonance of the associated instrument; may be economically manufactured; may be attached to a musical instrument without marring or scratching the instrument; and provides means for hygienically handling the disposal of moisture collected from a brass musical instrument.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A device for attachment to the water key of a brass musical instrument comprising:

a main body portion, having a bottom and side wall means extending away from the bottom defining a channel-shaped cavity; and means integral with and extending from said main body portion for intimate selective attachment only to the water key of the brass instrument.

2. The invention defined in claim 1 wherein said means for selective attachment to the water key includes spring clip means.

3. The invention defined in claim 2 wherein said spring clip means includes a pair of spring arms normally spring biased toward one another sufficiently adjacent to selectively be secured to the water key.

4. The invention defined in claim 1 including moisture absorbent material contained within the cavity.

5. The invention defined in claim 1 wherein said means integral with and extending from said main body portion includes arm means embraceable about the water key.

6. The invention defined in claim 5 wherein said arm means includes a pair of arms secured in water key embracing relation by an adhesive.

7. The invention defined in claim 6 wherein said adhesive is pressure sensitive.

* * * * *